US012110816B1

(12) United States Patent
Schubring et al.

(10) Patent No.: US 12,110,816 B1
(45) Date of Patent: Oct. 8, 2024

(54) HYBRID VEHICLE GASOLINE PARTICULATE FILTER REGENERATION

(71) Applicant: FCA US LLC, Auburn Hills, MI (US)

(72) Inventors: Brett Schubring, Macomb, MI (US); Brian E Hallgren, Milford, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 18/459,608

(22) Filed: Sep. 1, 2023

(51) Int. Cl.
*F01N 3/02* (2006.01)
*F01N 3/021* (2006.01)
*F01N 3/023* (2006.01)

(52) U.S. Cl.
CPC ..... *F01N 3/023* (2013.01); *F01N 3/021* (2013.01)

(58) Field of Classification Search
CPC ..... F01N 3/023; F01N 3/021; F01N 3/035; F01N 3/0233; F01N 9/00; F01N 9/002; F01N 11/00; F01N 11/002; F01N 2900/1606; F01N 2900/1602; F01N 2900/1404; F01N 2550/04; F01N 2550/02; F01N 2610/03; F02D 41/029; F02D 41/1446; F02D 41/024; F02D 41/0055; F02D 41/123; F02D 41/027; F02D 41/025; F02D 2200/0812; F02D 2200/0802; B01D 2279/30; Y02A 50/20; Y02T 10/12; Y02T 10/40
See application file for complete search history.

(56) References Cited

U.S. PATENT DOCUMENTS

| | | | | |
|---|---|---|---|---|
| 11,560,823 | B2 * | 1/2023 | Dudar | F01N 3/021 |
| 2019/0292959 | A1 * | 9/2019 | Dudar | F01N 13/009 |
| 2020/0108823 | A1 * | 4/2020 | Lee | B60W 30/18009 |
| 2022/0080947 | A1 * | 3/2022 | Sugimoto | B60W 10/08 |

* cited by examiner

*Primary Examiner* — Dapinder Singh
(74) *Attorney, Agent, or Firm* — Jeremy J. Klobucar

(57) ABSTRACT

A hybrid electric vehicle (HEV) includes an internal combustion engine, a motor/generator configured to drive the internal combustion engine or be driven by the internal combustion engine to generate electricity to charge a high voltage battery and/or drive one or more electric traction motors, and an exhaust aftertreatment system having a gasoline particulate filter (GPF). A control system includes a controller for monitoring and performing a regeneration operation of the GPF. The controller is programmed to determine the GPF needs to be regenerated, and operate the internal combustion engine in fuel shut-off to generate a flow of air to the GPF to initiate a GPF regeneration.

14 Claims, 2 Drawing Sheets

HYBRID VEHICLE GASOLINE PARTICULATE FILTER REGENERATION

FIELD

The present application relates generally to vehicle engine exhaust treatment systems and, more particularly, to systems for gasoline particulate filter regeneration in hybrid vehicles.

BACKGROUND

Gasoline Particulate Filters (GPF) are utilized in internal combustion engine (ICE) exhaust systems to remove particulate matter (soot) from the engine exhaust. GPF's typically require periodic cleaning (regeneration) to remove accumulated soot by increasing the exhaust temperature to initiate a combustion of the soot. Some conventional ICE vehicles utilize fuel shut-off (FSO) when engine power is not required, which allows for oxygen to reach the GPF. When the GPF is hot enough, a reaction occurs with the oxygen to oxidize the soot and clean the GPF. However, in some hybrid vehicles, the engine is completely shut-off when engine power is not required, thereby preventing oxygen from reaching the GPF. Accordingly, while such conventional systems work well for their intended purpose, there is a desire for improvement in the relevant art.

SUMMARY

In accordance with one example aspect of the invention, a hybrid electric vehicle (HEV) is provided. In one example implementation, the HEV includes an internal combustion engine, a motor/generator configured to drive the internal combustion engine or be driven by the internal combustion engine to generate electricity to charge a high voltage battery and/or drive one or more electric traction motors, and an exhaust aftertreatment system having a gasoline particulate filter (GPF). A control system includes a controller for monitoring and performing a regeneration operation of the GPF. The controller is programmed to determine the GPF needs to be regenerated, and operate the internal combustion engine in fuel shut-off to generate a flow of air to the GPF to initiate a GPF regeneration.

In addition to the foregoing, the described HEV may include one or more of the following features: wherein the controller is further programmed to monitor a soot accumulation and a temperature of the GPF; wherein the controller is further programmed to determine if the soot accumulation meets or exceeds a predetermined threshold indicating the GPF needs to be regenerated; wherein the controller is further programmed to determine if the GPF temperature meets or exceeds a predetermined threshold indicating a GPF regeneration can occur; and wherein if the GPF temperature does not meet or exceed the predetermined threshold, the controller is further programmed to load the engine via the motor/generator to increase an exhaust gas temperature to heat the GPF to the predetermined threshold.

In addition to the foregoing, the described HEV may include one or more of the following features: wherein if the GPF temperature meets or exceeds the predetermined threshold, the controller is configured to initiate the GPF regeneration; wherein during the GPF regeneration, the controller is further programmed to perform a closed loop GPF control to monitor and meter the flow of air to the GPF; wherein the controller is further programmed to determine the GPF regeneration is complete, and return the HEV to a normal operation by turning the engine off or ceasing the fuel shut-off; and wherein the HEV is a series hybrid electric vehicle.

In accordance with another example aspect of the invention, a method of operating a hybrid electric vehicle (HEV) is provided. The HEV includes an internal combustion engine, a motor/generator configured to drive the internal combustion engine or be driven by the internal combustion engine to generate electricity to charge a high voltage battery and/or drive one or more electric traction motors, and an exhaust aftertreatment system having a gasoline particulate filter (GPF). In one example implementation, the method includes determining, by a controller having one or more processors, if the GFP needs to be regenerated, and operating, by the controller and the motor/generator, the internal combustion engine in fuel shut-off to generate a flow of air to the GPF to initiate a GPF regeneration.

In addition to the foregoing, the described method may include one or more of the following features: monitoring, by the controller, a soot accumulation and a temperature of the GPF; determining, by the controller, if the soot accumulation meets or exceeds a predetermined threshold indicating the GPF needs to be regenerated; determining, by the controller, if the GPF temperature meets or exceeds a predetermined threshold indicating a GPF regeneration can occur; and if the GPF temperature does not meet or exceed the predetermined threshold, loading the engine, by the controller and the motor/generator, to increase an exhaust gas temperature to heat the GPF to the predetermined threshold.

In addition to the foregoing, the described method may include one or more of the following features: if the GPF temperature meets or exceeds the predetermined threshold, initiating the GPF regeneration by generating the flow of air to the GPF; during the GPF regeneration, performing, by the controller, a closed loop GPF control to monitor and meter the flow of air to the GPF; determining, by the controller, the GPF regeneration is complete, and returning, by the controller, the HEV to a normal operation by turning the engine off or ceasing the fuel shut-off; and wherein the HEV is a series hybrid electric vehicle.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

As discussed above, a gasoline particulate filter (GPF) cannot be regenerated (cleaned) by conventional means in series hybrid electric vehicles since the internal combustion engine is shut off when engine power is not required. Accordingly, described herein are systems and methods to regenerate a GPF in a series hybrid electric vehicle. The system is configured to provide both active and passive GPF regeneration. Passive regeneration relies on the GPF being hot enough during normal operation to oxidize the soot, and active regeneration takes active steps to initiate the regeneration.

During active regeneration, the system is configured to load the engine to produce increased heat in the exhaust system for GPF regeneration. This allows the battery to be charged with the increased engine load rather than operating the engine inefficiently with spark retard to produce heat. Once the GPF is at the correct temperature for oxidation to occur, the system is configured to electrically motor the engine without fueling to provide the proper amount of oxidation for a regeneration to occur since the series hybrid EV will not have FSO to regenerate the GPF. This advantageously reduces the chance of a thermal runaway event during the GPF regeneration.

Figure 1:
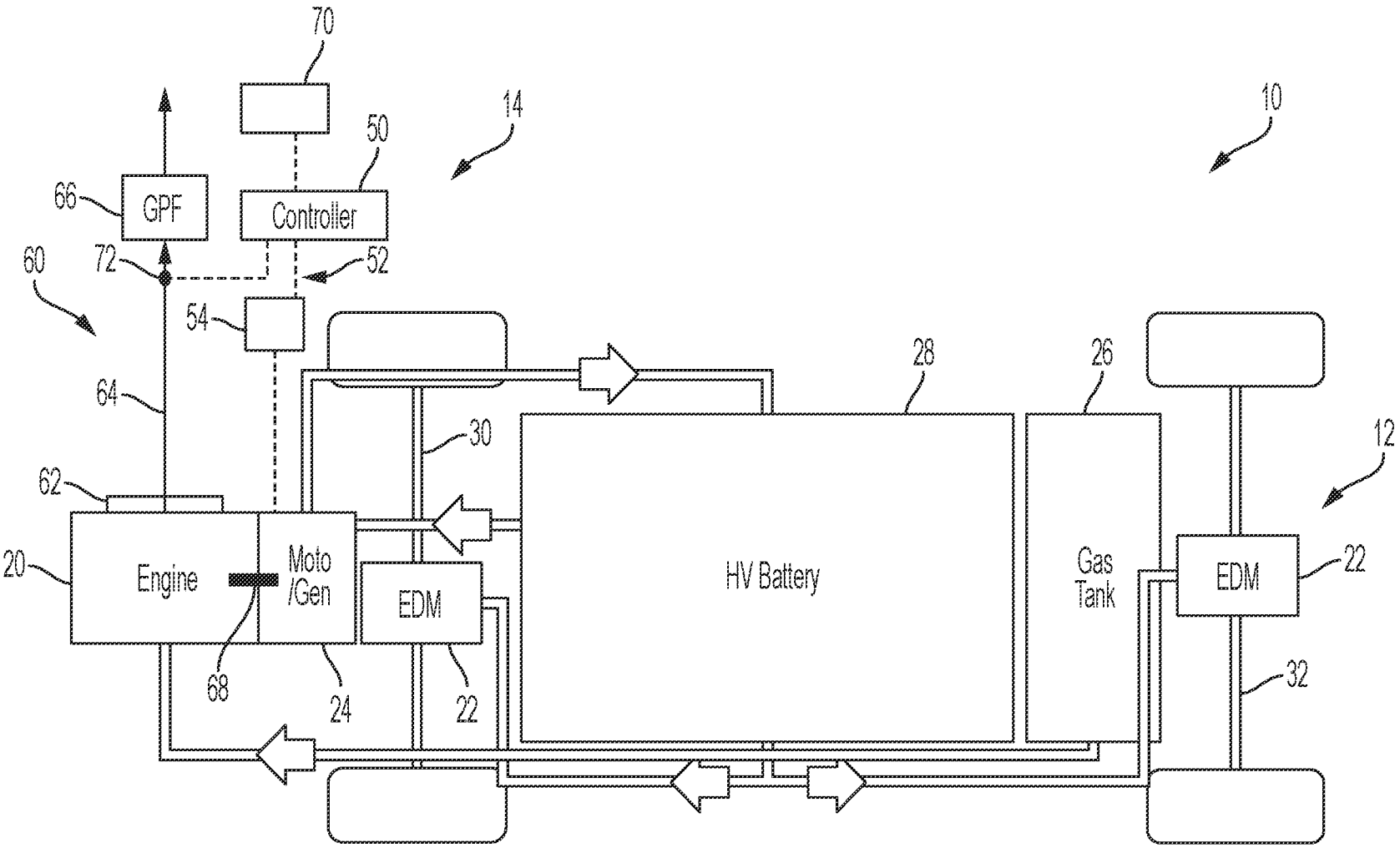
FIG. 1 is a schematic illustration of an example series hybrid electric vehicle architecture in accordance with the principles of the present application.

With initial reference to FIG. 1, a schematic diagram of a series hybrid electric vehicle (HEV) 10 is illustrated having a hybrid powertrain 12 and a powertrain control system 14 according to example implementations of the disclosure. In the illustrated example, the powertrain 12 generally includes an internal combustion engine 20, one or more electric drive modules (EDM) 22, and a motor/generator 24.

The engine 20 receives fuel (e.g., gasoline) from a fuel tank 26 and combusts a mixture of air and fuel within cylinders to drive pistons and generate torque. The generated torque drives the motor/generator 24 to produce electricity to charge a high voltage (HV) battery 28. In other operations, the motor/generator 24 is powered by the HV battery 28 (e.g., via a low voltage battery system) and is also utilized to control engine stop/start operations to improve vehicle fuel economy. The EDMs 22, which include an electric traction motor, are powered by the HV battery 28 to selectively provide drive torque to a front axle 30 and/or a rear axle 32. In this way, the HEV 10 includes a low voltage battery system (not shown) configured to support various 12V loads of the HEV 10, for example, to power various electrical components or start the engine 20, and the high voltage battery 28 is configured to power high voltage loads such as the EDMs 22.

In the example embodiment, the hybrid powertrain 12 is controlled by the powertrain control system 14, which generally includes one or more controllers 50, such as a hybrid control processor (HCP) and/or engine control unit (ECU). The controller 50 is a central supervisory control configured to communicate with various components/modules of the hybrid powertrain 12 via a CAN bus 52. For example, the controller may be in signal communication with a motor control processor (MCP) 54 for control of the motor/generator 24.

With continued reference to FIG. 1, the internal combustion engine 20 is connected to an exhaust aftertreatment system 60 that generally includes an exhaust manifold 62, an exhaust passage 64, and a gasoline particulate filter (GPF) 66 disposed along the exhaust passage 64 and configured to collect and remove particulate matter. In general, the engine 20 combusts a mixture of fuel and air to drive pistons (not shown) that rotatably turn a crankshaft 68 to generate drive torque. The drive torque is transferred to the motor/generator 24 to generate electricity, which is subsequently stored in the HV battery 28. Although not shown, the exhaust aftertreatment system 60 may include or more catalytic converters to reduce or convert a desired exhaust gas constituent such as, for example, carbon monoxide (CO), hydrocarbon (HC), and/or nitrogen oxides (NOx).

The exhaust aftertreatment system 60 also includes an onboard monitoring system 70 in signal communication with the controller 50 to monitor the GPF 66. The monitoring system 70 may include one or more models (e.g., stored in controller 50) to determine an amount of particulate matter (soot) buildup in the GPF 66. The monitoring system 70 may also include or more sensors 72 for monitoring the GPF 66, such as a temperature sensor to monitor a temperature of the GPF 66 to determine if the GPF temperature has exceeded a predetermined threshold for GPF regeneration. The sensor 72 may also include delta pressure sensors configured to sense if the GPF 66 is full, including sensors disposed upstream and downstream (not shown) of the GPF 66 to determine a pressure differential thereof. In this way, controller 50 and monitoring system 70 are configured to monitor the exhaust aftertreatment system 60 to determine if conditions exist to initiate a GPF regeneration. Accordingly, as described herein in more detail, powertrain control system 14 is configured to perform a passive or active regeneration of the GPF 66 of the series hybrid EV 10.

Figure 2:
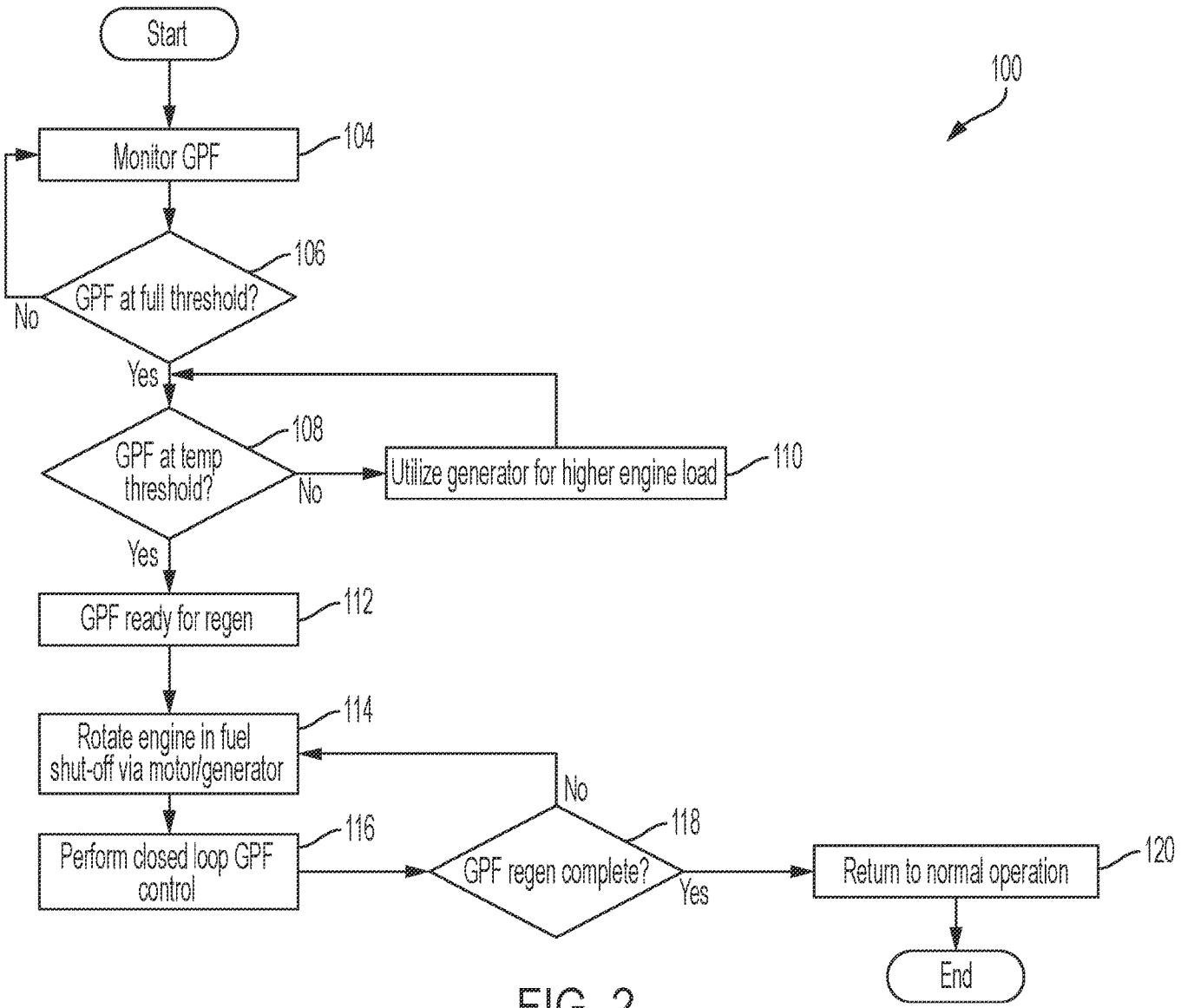
FIG. 2 illustrates an example control logic flow for performing a gasoline particulate filter regeneration in the series hybrid electric vehicle shown in FIG. 1, in accordance with the principles of the present application.

With reference now to FIG. 2, an example control logic flow 100 for a GPF regeneration is provided. At step 104, controller 50 monitors the GPF 66 soot level and temperature, for example, via onboard monitoring system 70 and temperature sensor 72. At step 106, controller 50 determines if GPF soot accumulation is greater than a predetermined threshold (e.g., at or near "full" accumulation). In one example, this determination is made based on a model stored in the onboard monitoring system 70 and/or controller 50. If the GPF 66 is not full, control returns to step 104. If the GPF 66 is full, control proceeds to step 108.

In the example embodiment, at step 108, controller 50 determines if a temperature of the GFP 66 is greater than or equal to a predetermined regeneration temperature suitable for performing a GPF regeneration operation (e.g., a temperature for oxidation to occur). If yes, control proceeds to step 112 to perform a passive regeneration operation. If no, control proceeds to step 110 to perform an active regeneration operation where controller 50 commands the motor/generator 24 to increase the load on engine 20. For example, the controller 50 adjusts phase current to apply more load to engine 20 so the engine has to work harder. In this way, the engine 20 generates more thermal energy, which is directed into the exhaust aftertreatment system 60 to increase the temperature of the GPF 66. Control then returns to step 108.

If the GPF temperature is above the predetermined regeneration temperature, control proceeds to step 112 and controller 50 determines the GPF 66 is ready for a regeneration operation. At step 114, controller 50 operates the motor/generator 24 to spin the engine 20 (via crankshaft 68) in fuel shut-off. In this way, the engine 20 generates a flow of air (without fuel) through the exhaust passage 64 to the GPF 66 to initiate GPF regeneration. At step 116, controller 50 monitors the GPF 66 and performs a closed loop GPF control of the GPF 66 to ensure proper regeneration. For example, controller 50 monitors and meters airflow, temperature, and soot level at the GPF 66 via onboard monitoring system 70 (models) and temperature sensor 72. At step 118, controller 50 determines if the GPF regeneration operation is complete. If no, control returns to step 116. If yes, control proceeds to step 120 and returns the HEV 10 to a normal operation. For example, depending on the desired operation, controller 50 turns engine 20 off or resumes supply of fuel to engine 20. Control then ends or returns to step 104.

Described herein are systems and methods for regenerating a GPF in a series hybrid electric vehicle. The system monitors the GPF soot level and when a regeneration is required, the system determines if the GPF is at a regeneration temperature. If yes, the system proceeds with a passive regeneration operation. If not, the system proceeds with an active regeneration operation and loads the engine with a motor/generator to increase exhaust temperature and raise the GPF to regeneration temperature. The system then operates the engine in fuel shut-off to generate a flow of air to the GPF to initiate the regeneration operation. The system monitors and controls airflow to control the regeneration and returns to normal operation when the GPF regeneration is complete.

It will be appreciated that the term "controller" or "module" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present application, its application or uses. Thus, variations that do not depart from the gist of the present application are intended to be within the scope of the present application.

What is claimed is:

1. A series hybrid electric vehicle (HEV), comprising:

one or more electric traction motors configured to provide drive torque to one or more vehicle axles;

an internal combustion engine;

a motor/generator configured to drive the internal combustion engine or be driven by the internal combustion engine to generate electricity to charge a high voltage battery and/or drive the one or more electric traction motors;

an exhaust aftertreatment system having a gasoline particulate filter (GPF); and a control system including a controller for monitoring and performing a regeneration operation of the GPF, wherein the controller is programmed to:

determine the GPF needs to be regenerated;

determine if a temperature of the GPF meets or exceeds a predetermined threshold indicating a GPF regeneration can occur;

if the GPF temperature does not meet or exceed the predetermined threshold, load the engine via the motor/generator to increase an exhaust gas temperature to heat the GPF to the predetermined threshold; and if the temperature meets or exceeds the predetermined threshold, operate the internal combustion engine in fuel shut-off to generate a flow of air to the GPF to initiate the GPF regeneration.

2. The HEV of claim 1, wherein the controller is further programmed to monitor a soot accumulation of the GPF.

3. The HEV of claim 2, wherein the controller is further programmed to determine if the soot accumulation meets or exceeds a predetermined threshold indicating the GPF needs to be regenerated.

4. The HEV of claim 1, wherein the controller is programmed to load the engine by adjusting a phase current of the motor/generator to thereby apply more load to the engine such that the engine generates increased thermal energy to increase the temperature of the GPF.

5. The HEV of claim 1, further comprising a crankshaft rotatably coupled between the engine and the motor/generator, wherein applying the load to the engine includes generating, by the motor/generator, a force on the crankshaft to cause the engine to work harder and increase the exhaust gas temperature.

6. The HEV of claim 1, wherein during the GPF regeneration, the controller is further programmed to perform a closed loop GPF control to monitor and meter the flow of air to the GPF.

7. The HEV of claim 1, wherein the controller is further programmed to:

determine the GPF regeneration is complete; and return the HEV to a normal operation by turning the engine off or ceasing the fuel shut-off.

8. A method of operating a series hybrid electric vehicle (HEV) having one or more electric traction motors configured to provide drive torque to one or more vehicle axles, an internal combustion engine, a motor/generator configured to drive the internal combustion engine or be driven by the internal combustion engine to generate electricity to charge a high voltage battery and/or drive the one or more electric traction motors, and an exhaust aftertreatment system having a gasoline particulate filter (GPF), the method comprising:

determining, by a controller having one or more processors, if the GPF needs to be regenerated;

determining, by the controller, if a temperature of the GPF meets or exceeds a predetermined threshold indicating a GPF regeneration can occur;

if the GPF temperature does not meet or exceed the predetermined threshold, loading the engine via the motor/generator to increase an exhaust gas temperature to heat the GPF to the predetermined threshold; and if the temperature meets or exceeds the predetermined threshold, operating, by the controller and the motor/generator, the internal combustion engine in fuel shut-off to generate a flow of air to the GPF to initiate the GPF regeneration.

9. The method of claim 8, further comprising monitoring, by the controller, a soot accumulation of the GPF.

10. The method of claim 8, further comprising determining, by the controller, if the soot accumulation meets or exceeds a predetermined threshold indicating the GPF needs to be regenerated.

11. The method of claim 8, wherein loading the engine includes adjusting a phase current of the motor/generator to thereby apply more load to the engine such that the engine generates increased thermal energy to increase the temperature of the GPF.

12. The method of claim 8, wherein a crankshaft is rotatably coupled between the engine and the motor/generator, and wherein applying the load to the engine includes generating, by the motor/generator, a force on the crankshaft to cause the engine to work harder and increase the exhaust gas temperature.

13. The method of claim 8, further comprising, during the GPF regeneration, performing, by the controller, a closed loop GPF control to monitor and meter the flow of air to the GPF.

14. The method of claim 8, further comprising:

determining, by the controller, the GPF regeneration is complete; and returning, by the controller, the HEV to a normal operation by turning the engine off or ceasing the fuel shut-off.

* * * * *